US011022355B2

(12) United States Patent
Iancu et al.

(10) Patent No.: US 11,022,355 B2
(45) Date of Patent: Jun. 1, 2021

(54) CONVERGING SUCTION LINE FOR COMPRESSOR

(71) Applicant: Johnson Controls Technology Company, Auburn Hills, MI (US)

(72) Inventors: Florin V. Iancu, Silver Spring, MD (US); Justin P. Kauffman, York, PA (US); Jeb W. Schreiber, Stewartstown, PA (US); Chenggang Wu, Wuxi (CN); Steven Wang, Wuxi (CN); John Trevino, Jr., York, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 76 days.

(21) Appl. No.: 15/934,687

(22) Filed: Mar. 23, 2018

(65) Prior Publication Data

US 2018/0274831 A1 Sep. 27, 2018

Related U.S. Application Data

(60) Provisional application No. 62/476,525, filed on Mar. 24, 2017.

(51) Int. Cl.
*F25B 41/00* (2021.01)
*F15D 1/04* (2006.01)
(Continued)

(52) U.S. Cl.
CPC ..... *F25B 41/40* (2021.01); *F04D 17/10* (2013.01); *F04D 29/4213* (2013.01); *F15D 1/04* (2013.01);
(Continued)

(58) Field of Classification Search
CPC ..... F25B 41/06; F25B 1/053; F25B 41/003; F15D 1/04; F04D 29/4213; F04D 17/10; F04D 25/163
See application file for complete search history.

(56) References Cited

U.S. PATENT DOCUMENTS 2,770,106 A 11/1956 Moody
2,921,445 A 1/1960 Ashley et al.
(Continued)

FOREIGN PATENT DOCUMENTS

DE 10 2011 110 285 A1 12/2012
DE 10 2014 212 909 A1 1/2016
(Continued)

OTHER PUBLICATIONS

Carrier. Product Data AquaEdge High-Efficiency Semi-Hermetic Centrifugal Liquid Chillers 500 to 800 Nominal Tons (1758 to 2814 Nominal kW), Jul. 1, 2018. 28 pages.

*Primary Examiner* — Frantz F Jules
*Assistant Examiner* — Martha Tadesse
(74) *Attorney, Agent, or Firm* — Fletcher Yoder, P.C.

(57) ABSTRACT

A compressor includes an inlet and the inlet includes a flange and an impeller eye. The flange is connected to a suction line that transfers a refrigerant into the compressor via the impeller eye. The refrigerant flows into the compressor with an amount of swirl and a pressure loss. The suction line includes a geometry that includes a constantly decreasing cross-sectional area in a direction towards the compressor. The geometry of the suction line is configured to reduce the amount of swirl and the pressure loss.

17 Claims, 5 Drawing Sheets

(51) Int. Cl.

| | |
|---|---|
| ***F25B 41/06*** | (2006.01) |
| ***F25B 41/40*** | (2021.01) |
| ***F04D 17/10*** | (2006.01) |
| ***F04D 29/42*** | (2006.01) |
| ***F25B 1/053*** | (2006.01) |
| ***F25B 41/30*** | (2021.01) |

(52) U.S. Cl.
CPC ..... *F25B 1/053* (2013.01); *F25B 41/30* (2021.01); *F25B 2500/01* (2013.01)

(56) References Cited

U.S. PATENT DOCUMENTS

| | | | | |
|---|---|---|---|---|
| 3,149,478 | A | 9/1964 | Anderson et al. | |
| 3,645,112 | A | 2/1972 | Mount et al. | |
| 4,182,137 | A | 1/1980 | Erth | |
| 5,319,945 | A * | 6/1994 | Bartlett | F25B 45/00 62/174 |
| 5,829,265 | A | 11/1998 | Lord et al. | |
| 6,032,472 | A | 3/2000 | Heinrichs et al. | |
| 6,070,421 | A | 6/2000 | Petrovich et al. | |
| 6,237,353 | B1 | 5/2001 | Sishtla et al. | |
| 6,460,371 | B2 | 10/2002 | Kawada | |
| 6,506,031 | B2 | 1/2003 | Sishtla | |
| 6,668,580 | B2 * | 12/2003 | MacBain | F16L 43/001 138/37 |
| 6,845,843 | B2 | 1/2005 | Svendsen et al. | |
| 7,181,928 | B2 | 2/2007 | De Larminat | |
| 8,021,127 | B2 | 9/2011 | De Larminat | |
| 8,147,220 | B2 | 4/2012 | Yanagisawa et al. | |
| 8,230,968 | B2 | 7/2012 | Jung et al. | |
| 8,397,534 | B2 | 3/2013 | Doty et al. | |
| 8,424,339 | B2 | 4/2013 | Sommer | |
| 8,434,323 | B2 | 5/2013 | Welch et al. | |
| 8,465,265 | B2 | 6/2013 | De Larminat | |
| 8,516,850 | B2 * | 8/2013 | Jadric | H02K 9/10 62/505 |
| 8,931,304 | B2 | 1/2015 | Beers et al. | |
| 8,959,950 | B2 * | 2/2015 | Doty | F25B 31/006 62/505 |
| 9,217,444 | B2 * | 12/2015 | Berger | F04D 29/4213 |
| 9,291,166 | B2 | 3/2016 | De Larminat et al. | |
| 9,291,167 | B2 | 3/2016 | Schreiber | |
| 9,335,079 | B2 | 5/2016 | Huff et al. | |
| 9,556,875 | B2 | 1/2017 | Haley et al. | |
| 2003/0150670 | A1 | 8/2003 | Svendsen et al. | |
| 2007/0271956 | A1 | 11/2007 | Smith et al. | |
| 2008/0098758 | A1 | 5/2008 | Moriwaki et al. | |
| 2010/0006265 | A1 * | 1/2010 | De Larminat | H02K 9/10 165/104.21 |
| 2011/0214421 | A1 * | 9/2011 | Schmitt | F02B 39/00 60/605.2 |
| 2012/0100011 | A1 * | 4/2012 | Sommer | F04D 29/058 417/44.1 |
| 2013/0125570 | A1 * | 5/2013 | Doty | F04D 29/284 62/115 |
| 2013/0302184 | A1 | 11/2013 | Sishtla | |
| 2014/0057103 | A1 | 2/2014 | Mozsgai et al. | |
| 2014/0127059 | A1 * | 5/2014 | Haley | F04D 25/06 417/423.1 |
| 2015/0007604 | A1 * | 1/2015 | Hu | F28B 1/02 62/507 |
| 2015/0050136 | A1 * | 2/2015 | Tomita | F02M 35/10157 415/206 |
| 2015/0096315 | A1 * | 4/2015 | Li | F25B 43/00 62/115 |
| 2015/0354863 | A1 * | 12/2015 | Jandal | F25B 31/002 62/115 |

FOREIGN PATENT DOCUMENTS

| | | | | |
|---|---|---|---|---|
| EP | 1 119 732 | A1 | 8/2001 | |
| EP | 1 120 611 | | 8/2001 | |
| EP | 1 808 653 | | 7/2007 | |
| EP | 2 944 827 | | 11/2015 | |
| JP | 2005-146866 | A | 6/2005 | |
| WO | WO-2004/081379 | | 9/2004 | |
| WO | WO-2013/039572 | A1 | 3/2013 | |
| WO | WO-2014/039155 | A2 | 3/2014 | |
| WO | WO-2014/084989 | A2 | 6/2014 | |
| WO | WO-2014/089551 | A1 | 6/2014 | |
| WO | WO-2014/117015 | A1 | 7/2014 | |
| WO | WO-2014/200476 | A1 | 12/2014 | |
| WO | WO-2015/053939 | A1 | 4/2015 | |
| WO | WO-2016/001181 | A1 | 1/2016 | |
| WO | WO-2016001181 | A1 * | 1/2016 | F04D 29/441 |

* cited by examiner

| Capacity (Tons of Refrigeration) | 300 | 450 | 520 | 630 | 750 | 880 | 1000 | 1200 |
|---|---|---|---|---|---|---|---|---|
| Axial Length (in) | 28.000 | 28.000 | 31.000 | 35.000 | 37.000 | 39.898 | 42.000 | 46.310 |
| Height (in) | 20.000 | 24.540 | 22.673 | 25.000 | 26.500 | 26.772 | 28.580 | 31.190 |
| Evaporator Flange Diameter (in) | 17.250 | 19.250 | 21.250 | 23.250 | 25.250 | 27.250 | 29.250 | 31.250 |
| Compressor Flange Diameter (in) | 10.000 | 12.000 | 13.250 | 15.250 | 17.250 | 17.250 | 19.250 | 21.210 |
| Impeller Eye (in) | 7.755 | 9.515 | 11.178 | 12.326 | 13.432 | 14.518 | 15.499 | 16.914 |
| Compressor Inlet Axial Length (in) | 12.000 | 13.727 | 13.000 | 15.400 | 15.500 | 12.000 | 17.000 | 19.173 |
| Compressor Inlet Angle (deg) | 5.344 | 5.172 | 4.556 | 5.423 | 7.021 | 4.837 | 6.296 | 6.451 |
| Suction Line In/Out Diameter Ratio | 1.73 | 1.60 | 1.60 | 1.52 | 1.46 | 1.58 | 1.52 | 1.47 |

202 204 206 208 210 212 214 216

CONVERGING SUCTION LINE FOR COMPRESSOR

CROSS-REFERENCE TO RELATED PATENT APPLICATION

This application claims the benefit of and priority to U.S. Provisional Patent Application No. 62/476,525 filed Mar. 24, 2017, the entire disclosure of which is incorporated by reference herein.

BACKGROUND

Buildings can include heating, ventilation and air conditioning (HVAC) systems to distribute or control air circulation.

SUMMARY

One implementation of the present disclosure is a compressor. The compressor includes an inlet and the inlet includes a flange and an impeller eye. The flange is connected to a suction line that transfers a refrigerant into the compressor via the impeller eye. The refrigerant flows into the compressor with an amount of swirl and an amount of pressure loss. The suction line includes a geometry that includes a constantly decreasing cross-sectional area in a direction towards the compressor. The geometry of the suction line is configured to reduce the amount of swirl and the pressure loss.

Another implementation of the present disclosure is a chiller assembly. The chiller assembly includes an evaporator configured to convert a refrigerant into a vapor. The evaporator includes an evaporator flange. The chiller assembly further includes a compressor including an inlet. The inlet includes a compressor flange and an impeller eye. The compressor flange is connected to a suction line. The suction line is attached to the evaporator via the evaporator flange and is configured to transfer the refrigerant into the compressor via the impeller eye. The refrigerant flows into the compressor with an amount of swirl and a pressure loss. The suction line includes a geometry that includes a constantly decreasing cross-sectional area in a direction towards the compressor. The geometry of the suction line is configured to reduce the amount of swirl and the pressure loss. The chiller assembly further includes a condenser attached to the compressor via a discharge line and configured to convert the refrigerant into a liquid.

Another implementation of the present disclosure is a method. The method includes providing a compressor including an inlet. The inlet includes a flange and an impeller eye. The flange is connected to a suction line that transfers a refrigerant into the compressor via the impeller eye. The refrigerant flows into the compressor with an amount of swirl and an amount of pressure loss. The suction line includes a geometry that includes a constantly decreasing cross-sectional area in a direction towards the compressor. The geometry of the suction line is configured to reduce the amount of swirl and the pressure loss.

DETAILED DESCRIPTION

Referring generally to the FIGURES, a chiller assembly with an optimized compressor suction line is shown. The suction line is configured to transfer refrigerant from an evaporator to a compressor as part of a chiller cycle associated with the chiller assembly. Flow conditioning devices such as pre-rotation vanes (PRVs), inlet guide vanes (IGVs), and other components are often used to provide a uniform flow of refrigerant into the compressor. However, the suction line can be fabricated as a metal casting with a decreasing cross-sectional area in order to provide a uniform flow at the compressor inlet without these additional components. The absence of these components allows for a more compact design of both the compressor and the suction line, thereby reducing cost and footprint of the chiller. In addition, the suction line can deliver reduced pressure loss that drives improved chiller efficiency. The converging suction line can be designed for use with a variety of compressor types and sizes as well as a variety of refrigerants.

Figure 1:
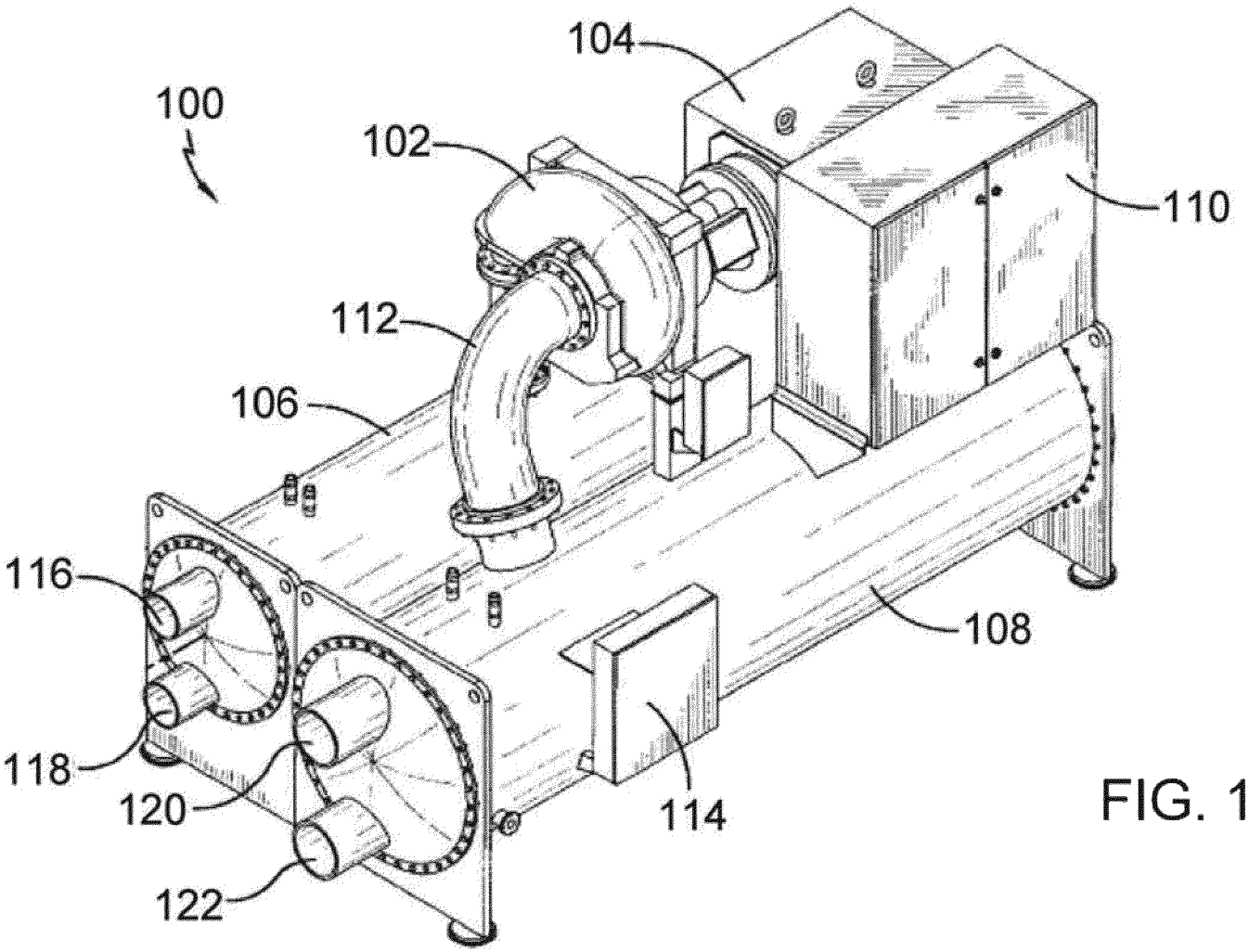
FIG. 1 is a drawing of a chiller assembly.

Referring now to FIG. 1, an example implementation of a chiller assembly 100 is shown. Chiller assembly 100 is shown to include a compressor 102 driven by a motor 104, a condenser 106, and an evaporator 108. A refrigerant is circulated through chiller assembly 100 in a vapor compression cycle. Chiller assembly 100 can also include a control panel 114 to control operation of the vapor compression cycle within chiller assembly 100.

Motor 104 can be powered by a variable speed drive (VSD) 110. VSD 110 receives alternating current (AC) power with a particular fixed line voltage and fixed line frequency from an AC power source (not shown) and provides power having a variable voltage and frequency to motor 104. Motor 104 can be any type of electric motor than can be powered by a VSD 110. For example, motor 104 can be a high speed induction motor. Compressor 102 is driven by motor 104 to compress a refrigerant vapor received from evaporator 108 through a suction line 112. Compressor 102 then delivers compressed refrigerant vapor to condenser 106 through a discharge line. Compressor 102 can be a centrifugal compressor, a screw compressor, a scroll compressor, a turbine compressor, or any other type of suitable compressor.

Evaporator 108 includes an internal tube bundle (not shown), a supply line 120 and a return line 122 for supplying and removing a process fluid to the internal tube bundle. The supply line 120 and the return line 122 can be in fluid communication with a component within a HVAC system (e.g., an air handler) via conduits that circulate the process fluid. The process fluid is a chilled liquid for cooling a building and can be, but is not limited to, water, ethylene glycol, calcium chloride brine, sodium chloride brine, or any other suitable liquid. Evaporator 108 is configured to lower the temperature of the process fluid as the process fluid passes through the tube bundle of evaporator 108 and exchanges heat with the refrigerant. Refrigerant vapor is formed in evaporator 108 by the refrigerant liquid delivered to the evaporator 108 exchanging heat with the process fluid and undergoing a phase change to refrigerant vapor.

Refrigerant vapor delivered by compressor 102 to condenser 106 transfers heat to a fluid. Refrigerant vapor condenses to refrigerant liquid in condenser 106 as a result of heat transfer with the fluid. The refrigerant liquid from condenser 106 flows through an expansion device and is returned to evaporator 108 to complete the refrigerant cycle of the chiller assembly 100. Condenser 106 includes a supply line 116 and a return line 118 for circulating fluid between the condenser 106 and an external component of the HVAC system (e.g., a cooling tower). Fluid supplied to the condenser 106 via return line 118 exchanges heat with the refrigerant in the condenser 106 and is removed from the condenser 106 via supply line 116 to complete the cycle. The fluid circulating through the condenser 106 can be water or any other suitable liquid.

Figures 2, 3:
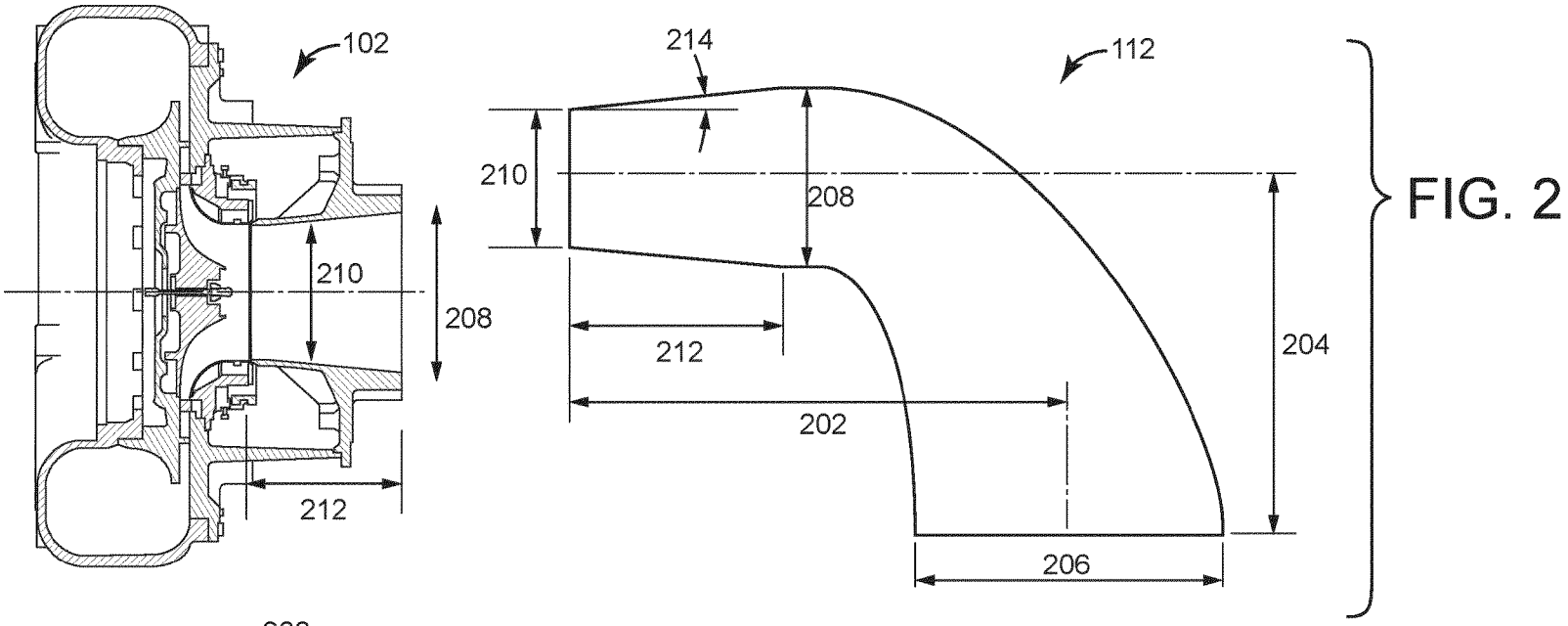
FIG. 2 is a drawing of a compressor and a suction line associated with the chiller assembly of FIG. 1.
FIG. 3 is a table including various examples of dimensional characteristics associated with the compressor inlet and the suction line of FIG. 2.

Referring now to FIG. 2, various dimensional characteristics associated with suction line 112 and compressor 102 are shown. An inlet to compressor 102 includes a flange and an impeller eye. The flange can be configured to attach compressor 102 to suction line 112. The impeller eye can be configured to accept refrigerant into compressor 102 via suction line 112. As shown in FIG. 2, the impeller eye can be defined by a diameter 210 and the compressor flange can be defined by a diameter 208. The compressor inlet is defined by compressor inlet length 212. Compressor inlet angle 214 can be defined as the angle from the top of the impeller eye to the top of the compressor flange relative to the horizontal direction as shown in FIG. 2.

Suction line 112 can be attached to evaporator 108 via an evaporator flange. The evaporator flange can be defined by a diameter 206 that is greater than compressor flange diameter 208. A height 204 of suction line 112 can be defined from the evaporator flange to the center of the compressor flange as shown in FIG. 2. An axial length 202 of suction line 112 can be defined from the center of the evaporator flange to the impeller eye. As can be inferred from FIG. 2, refrigerant flowing through suction line 112 makes approximately a 90 degree turn.

Referring now to FIG. 3, a table 300 including example values of the dimensional characteristics defined in FIG. 2 is shown. As mentioned above, the converging suction line design can be applied to a variety of chillers that use a variety of different compressors and a variety of refrigerant types. Table 300 lists dimensional characteristics associated with compressor capacities of 300, 450, 520, 630, 750, 880, 1000, and 1200 tons of refrigeration (TR). As a reference, typical operating conditions of chiller assembly 100 associated with the data in table 300 include a suction pressure of about 8.8 psia, a suction temperature of about 43.1° F., a suction density of about $$0.22\ \frac{\text{lbm}}{\text{ft}^3},$$

and a low pressure remgerant (e.g., R1233zd). Dimensional characteristics shown in table 300 include suction line axial length 202, suction line height 204, evaporator flange diameter 206, compressor flange diameter 208, impeller eye diameter 210, compressor inlet axial length 212, and compressor inlet angle 214. Also shown in table 300 is a ratio 216 of suction line inlet diameter (i.e., evaporator flange diameter 206) to suction line outlet diameter (i.e., compressor flange diameter 208). It should be noted that the numbers shown in table 300 are examples and slight variations are contemplated within the scope of the present disclosure. The general relationships and design principles that can be inferred from table 300 result in a high performance suction line 112.

The dimensional characteristics shown in table 300 highlight key features of the design of suction line 112. For example, it can be inferred from table 300 that, depending on compressor size, compressor inlet angle 214 should be between 4 and 10 degrees. In addition, it can be inferred from table 300 that ratio 216 of evaporator flange diameter to compressor flange diameter should be between 1.4 and 1.8. Further, it can be inferred that a ratio of external suction line height to length $$\left(\text{i.e., external height to length} = \frac{\text{height 204}}{\text{length 202} - \text{inlet length 212}}\right)$$

should be between 1.1 and 1.3.

Figure 4:
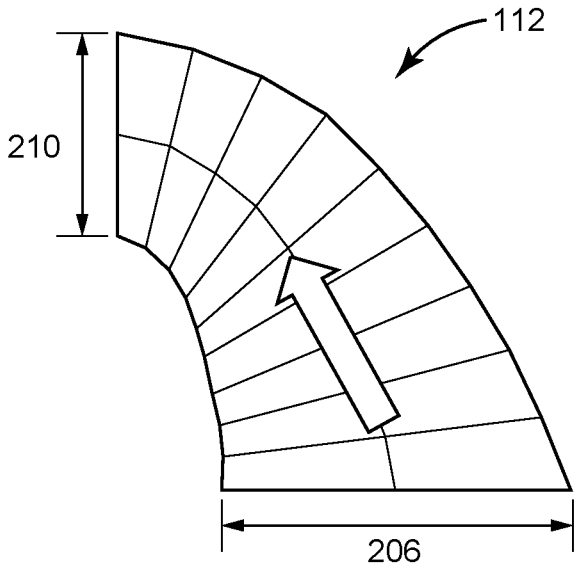
FIG. 4 is a drawing of discrete locations where cross-sectional area of the suction line of FIG. 2 can be calculated.

Referring now to FIG. 4, a drawing of discrete locations where cross-sectional area of suction line 112 can be calculated is shown. The arrow indicates the direction of refrigerant flow through suction line 112 from evaporator outlet 206 to compressor inlet 210. Each of the ten horizontal lines shown represents a cross section of suction line 112. It can be inferred from FIG. 4 that, in a direction towards the compressor, the cross-sectional area of suction line 112 decreases. For example, starting at the evaporator end, each successive horizontal line has a shorter length. Given that the cross-sectional area within suction line 112 can be defined as $A=\pi r^2$, a smaller diameter (and radius) corresponds to a smaller cross-sectional area. This concept of a decreasing cross-sectional area is consistent with and expands upon the dimensional characteristics and relationships shown in table 300.

Figure 5:
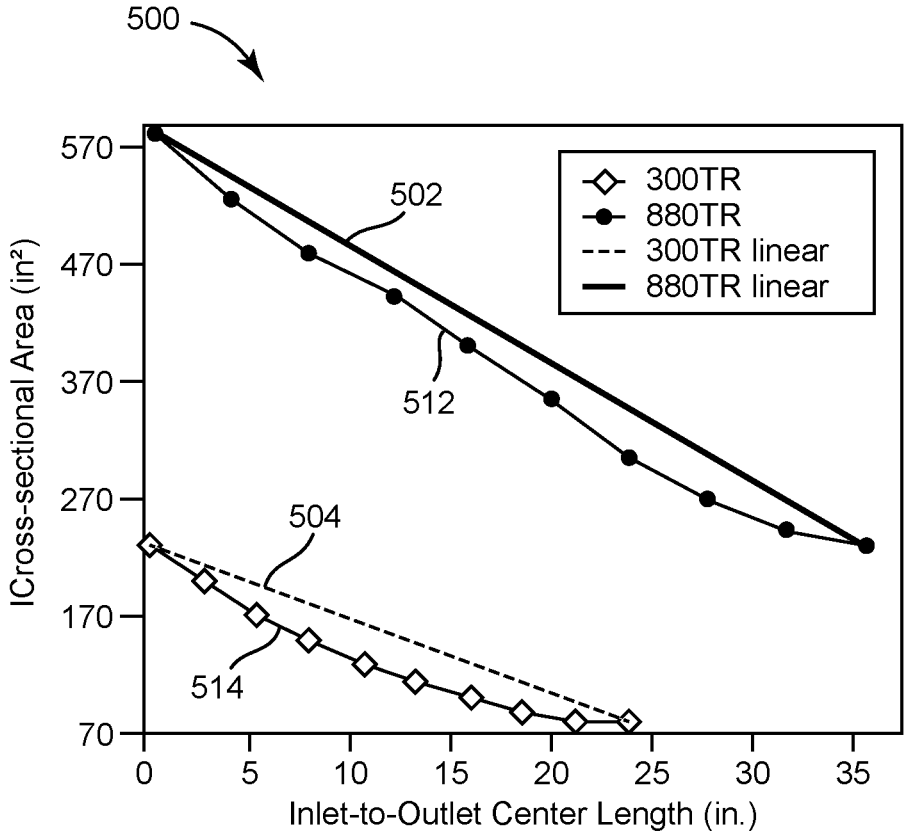
FIG. 5 is a graph of cross-sectional area over the length of the suction line of FIG. 2 for two different compressor sizes.

Referring now to FIG. 5, an example graph 500 of cross-sectional area of suction line 112 for two different compressor sizes is shown. Line 512 shows the cross-sectional area at ten evenly-spaced points (e.g., the locations shown in FIG. 4) of suction line 112 designed for a compressor size of 880TR. It can be seen from line 512 that, at each successive point, the cross-sectional area of suction line 112 decreases in a direction towards the compressor. Line 502 depicts a linear fit applied to the data points associated with line 512. Line 502 can be used as a reference to infer from graph 500 that the cross-sectional area of suction line 112 not only decreases, but it also decreases non-linearly (e.g., non-linear convergence). In a similar fashion, line 514 depicts the cross-sectional area of suction line 112 at ten evenly-spaced points and optimized for a compressor size of 300TR. Line 504 depicts a linear fit of the data points associated with line 514 and can be used as a reference to again infer that the cross-sectional area of suction line 112 decreases in a non-linear fashion.

Figure 6:
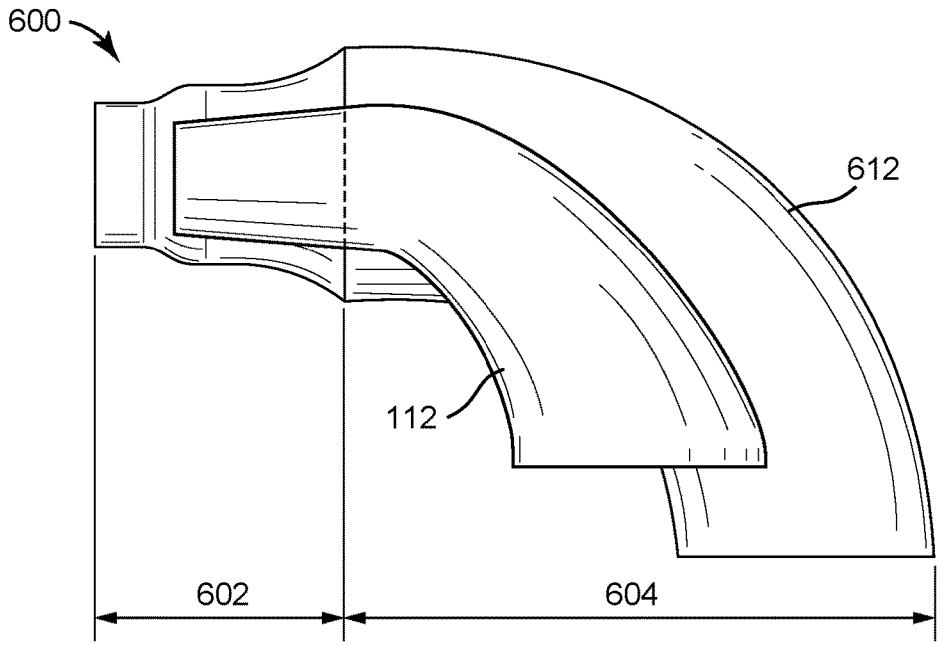
FIG. 6 is a drawing of the suction line of FIG. 2 compared to a suction line with alternative dimensional characteristics.

Referring now to FIG. 6, a drawing 600 of suction line 112 compared to a suction line 612 with alternative dimensional characteristics is shown. Drawing 600 shows suction line 112 and suction line 612 aligned at the start of the compressor inlet. A compressor inlet associated with suction lines 112 and 612, respectively, is represented by length 602. Suction lines 112 and 612 themselves are represented by length 604. Suction line 612 is shown to have a constant or relatively constant cross-sectional area. As a result, the flow of refrigerant entering a compressor via suction line 612 has a high amount of swirl, a large amount of pressure loss, and a high degree of non-uniformity (e.g., asymmetrical, flow velocity in some directions greater than flow velocity in other directions). In addition, the flow of refrigerant through suction line 612 may separate at the inner radius, thus forming a double counter-rotating vortex. As a result, additional components such as pre-rotation vanes (PRVs), inlet guide vanes (IGVs), and other flow conditioning devices are often used. The decreasing cross-sectional area and other dimensional characteristics of suction line 112 can be optimized for a variety of compressor sizes in order to decrease the amount of swirl, the amount of pressure loss, and provide more uniform flow of refrigerant into compressor 102. As a result, the overall size of both compressor 102 and suction line 112 can be reduced since flow conditioning devices and other components are not needed.

Figure 7:
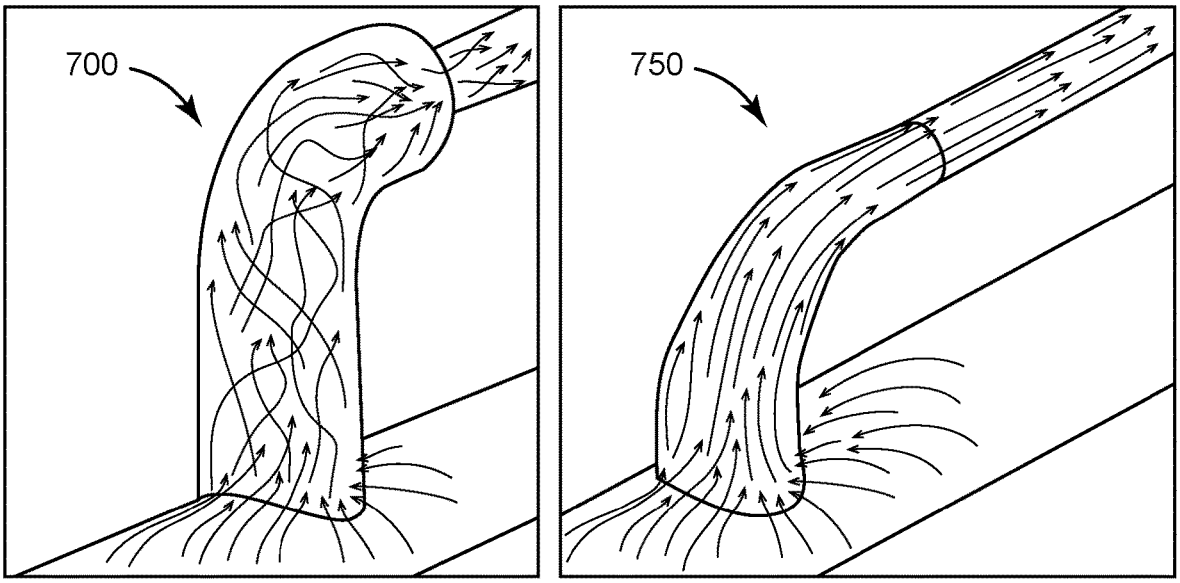
FIG. 7 is an illustration of refrigerant flow exiting the suction line with alternative dimensional characteristics shown in FIG. 6 and the suction line of FIG. 2.

Referring now to FIG. 7, an illustration 700 of refrigerant flow exiting suction line 612 and an illustration 750 of refrigerant flow exiting suction line 112 are shown. As shown in illustration 700, the flow of refrigerant exiting suction line 612 (e.g., a "long radius elbow") is much more non-uniform (e.g., asymmetrical) and has a higher amount of swirl than shown in illustration 750 for suction line 112. It can also be seen from illustrations 700 and 750 that that flow of refrigerant exiting suction line 612 has a much higher amount of radial separation when compared to the flow exiting suction line 112. Suction line 112 can deliver a reduction in pressure loss of about 35% and a reduction in swirl velocity of about 26% in some examples. A bell-shaped mouth or other type of complex design is often used at the compressor inlet with suction line 612, however such a complex design may not be needed as a result of the optimized design of suction line 112. Due to the reduction in pressure loss and other benefits associated with the design of suction line 112, a benefit to the overall chiller cycle executed by chiller assembly 100 can be seen without any loss in compressor performance.

Figure 8:
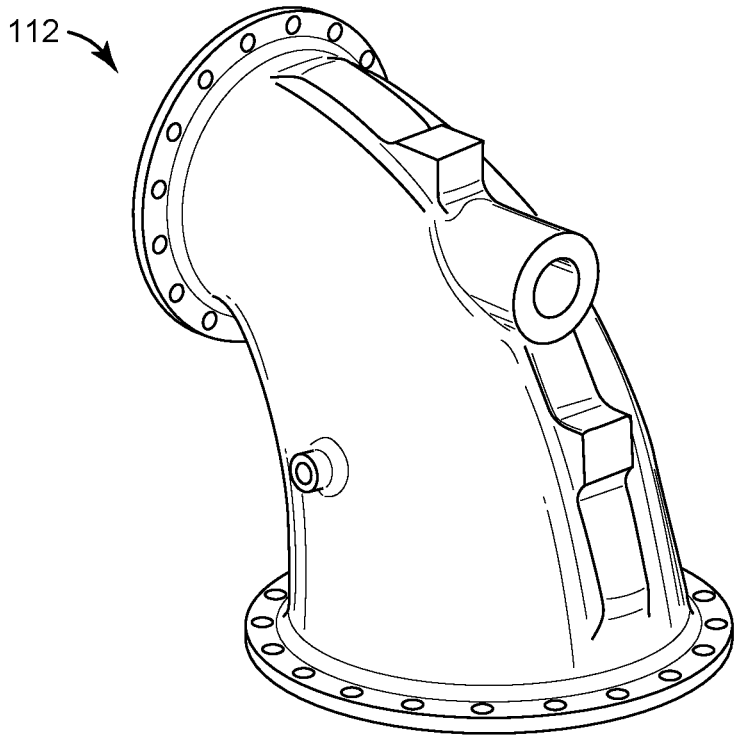
FIG. 8 is a drawing of the suction line of FIG. 2.
Figure 9:
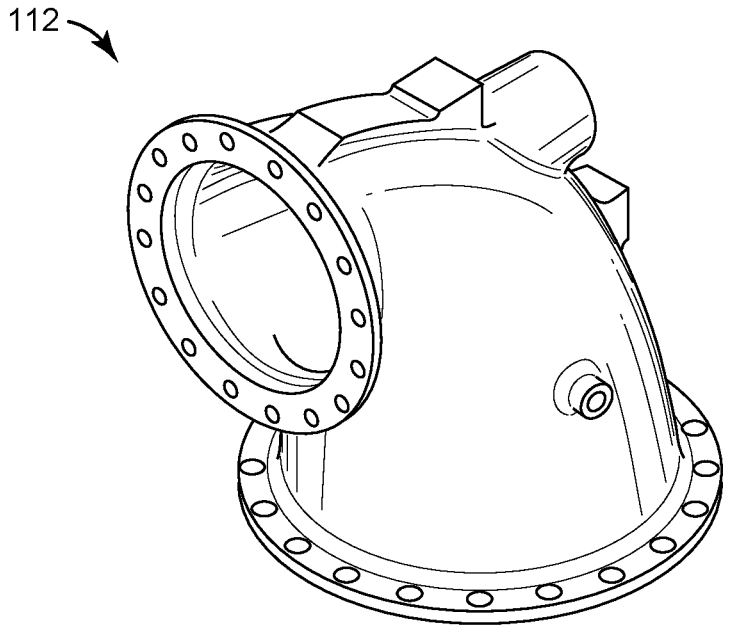
FIG. 9 is another drawing of the suction line of FIG. 2.

Referring now to FIG. 8, a perspective view drawing of suction line 112 is shown. Suction line 112 can be fabricated as a metal casting and can include a sight glass port and a pressure probe port. The sight glass port can be configured to allow operators, technicians, and other personnel to visually see refrigerant flowing through suction line 112. The pressure probe port can be configured to allow operators, technicians, and other personnel to measure pressure of refrigerant flowing through suction line 112. FIG. 9 shows a similar perspective view of suction line 112 from a different angle. Dimensional characteristics associated with suction line 112 such as decreasing cross-sectional can be seen in FIG. 8 and FIG. 9.

The construction and arrangement of the systems and methods as shown in the various exemplary embodiments are illustrative only. Although only example embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the examples provided without departing from the scope of the present disclosure.

What is claimed is:

1. A compressor, comprising:

an inlet including a flange and an impeller eye, the flange connected to a suction line that transfers a refrigerant into the compressor via the impeller eye;

wherein the suction line has a geometry that includes a constantly decreasing cross-sectional area throughout a length of the suction line in a direction towards the compressor, and wherein the constantly decreasing cross-sectional area decreases at a non-linear rate.

2. The compressor of claim 1, wherein the constantly decreasing cross-sectional area decreases at the non-linear rate such that the cross-section area decreases in the direction towards the compressor in a non-uniform manner.

3. The compressor of claim 1, wherein the compressor operates as part of a chiller assembly, the chiller assembly including an evaporator configured to convert the refrigerant into vapor, a motor configured to drive the compressor, and a condenser configured to convert the vapor into a liquid.

4. The compressor of claim 3, wherein the suction line is connected to the evaporator via an evaporator flange, and wherein the refrigerant is transferred from the evaporator and through the suction line to the compressor.

5. The compressor of claim 1, wherein a compressor inlet angle ranges from 4-10 degrees, the compressor inlet angle defined from a top edge of the impeller eye to a top edge of the flange.

6. The compressor of claim 4, wherein a ratio of diameter of the evaporator flange to diameter of the compressor flange ranges from 1.4 to 1.8.

7. The compressor of claim 1, wherein an external height to length ratio of the suction line ranges from 1.1 to 1.3.

8. The compressor of claim 1, wherein the suction line includes a pressure probe port configured to enable pressure measurements of the refrigerant.

9. The compressor of claim 1, wherein the suction line includes a sight glass port configured to enable sight of the refrigerant.

10. The compressor of claim 1, wherein the refrigerant completes a turn of approximately 90 degrees when flowing through the suction line and into the compressor.

11. The compressor of claim 4, wherein the refrigerant completes a turn of approximately 90 degrees when flowing out of the evaporator, through the suction line, and into the compressor.

12. The compressor of claim 1, wherein the refrigerant flows into the compressor with an amount of radial separation.

13. The compressor of claim 1, wherein the refrigerant flows into the compressor with an amount of non-uniformity.

14. The compressor of claim 12, wherein the geometry of the suction line is configured to reduce the amount of radial separation.

15. The compressor of claim 13, wherein the geometry of the suction line is configured to reduce the amount of non-uniformity.

16. A method, comprising:

providing a compressor, the compressor including an inlet including a flange and an impeller eye, the flange connected to a suction line that transfers a refrigerant into the compressor via the impeller eye;

wherein the suction line has a geometry that includes a constantly decreasing cross-sectional area throughout a length of the suction line in a direction towards the compressor, and wherein the constantly decreasing cross-sectional area decreases at a non-linear rate.

17. The method of claim 16, comprising providing the compressor without pre-rotation vanes or guide vanes.

* * * * *